US010411324B2

(12) United States Patent
Lin et al.

(10) Patent No.: US 10,411,324 B2
(45) Date of Patent: Sep. 10, 2019

(54) ANTENNA STRUCTURE OF A COMMUNICATIONS DEVICE

(71) Applicant: Quanta Computer Inc., Taoyuan (TW)

(72) Inventors: Hui Lin, Taoyuan (TW); Chun-I Lin, Taoyuan (TW); Hung-Ren Hsu, Taoyuan (TW); Jun-Yu Lu, Taoyuan (TW)

(73) Assignee: QUANTA COMPUTER INC., Guishan Dist., Taoyuan (TW)

( * ) Notice: Subject to any disclaimer, the term of this patent is extended or adjusted under 35 U.S.C. 154(b) by 0 days.

(21) Appl. No.: 15/830,300

(22) Filed: Dec. 4, 2017

(65) Prior Publication Data

US 2019/0044214 A1 Feb. 7, 2019

(30) Foreign Application Priority Data

Aug. 3, 2017 (TW) ..... 106126208 A

(51) Int. Cl.

| | |
|---|---|
| ***H01Q 1/24*** | (2006.01) |
| ***H01Q 1/22*** | (2006.01) |
| ***H01Q 1/40*** | (2006.01) |
| ***H01Q 1/48*** | (2006.01) |
| *H01Q 9/30* | (2006.01) |
| *H01Q 21/28* | (2006.01) |

(52) U.S. Cl.

CPC ..... *H01Q 1/2258* (2013.01); *H01Q 1/243* (2013.01); *H01Q 1/40* (2013.01); *H01Q 1/48* (2013.01); *H01Q 9/30* (2013.01); *H01Q 21/28* (2013.01)

(58) Field of Classification Search

CPC ..... H01Q 1/22–1/2266; H01Q 1/24–1/243; H01Q 1/40; H01Q 1/48

See application file for complete search history.

(56) References Cited

U.S. PATENT DOCUMENTS

| | | | | |
|---|---|---|---|---|
| 6,753,814 | B2 * | 6/2004 | Killen | H01Q 1/38 343/700 MS |
| 2004/0125019 | A1 * | 7/2004 | Rawnick | H01Q 1/38 343/700 MS |
| 2009/0295650 | A1 * | 12/2009 | Higaki | H01Q 1/243 343/702 |
| 2010/0039330 | A1 * | 2/2010 | Chien | H01Q 9/42 343/700 MS |
| 2012/0162029 | A1 * | 6/2012 | Yokoo | G04R 60/12 343/702 |
| 2017/0012342 | A1 | 1/2017 | Lai et al. | |
| 2017/0117614 | A1 * | 4/2017 | Wu | H01Q 1/243 |
| 2017/0346162 | A1 * | 11/2017 | Han | H01Q 1/40 |

FOREIGN PATENT DOCUMENTS

| | | | |
|---|---|---|---|
| TW | 201702789 | A | 1/2017 |
| WO | 2007037494 | A1 | 4/2007 |

* cited by examiner

*Primary Examiner* — Dameon E Levi
*Assistant Examiner* — Hasan Z Islam
(74) *Attorney, Agent, or Firm* — McClure, Qualey & Rodack, LLP

(57) ABSTRACT

A communications device includes a ground plane, a signal source, a filling material and an antenna. The signal source is electrically connected to the ground plane. The antenna has a predetermined metal pattern and is coupled to the signal source. The filling material is a non-conductive material and the filling material and the predetermined metal pattern are bonded heterogeneously via a surface-mount technology.

9 Claims, 10 Drawing Sheets

ANTENNA STRUCTURE OF A COMMUNICATIONS DEVICE

CROSS REFERENCE TO RELATED APPLICATIONS

This application claims priority of Taiwan Patent Application No. 106126208 filed on Aug. 3, 2017, the entirety of which is incorporated by reference herein.

BACKGROUND OF THE INVENTION

Field of the Invention

The disclosure generally relates to an antenna structure, and more specifically, to an antenna structure for use in a thin and light communications device which occupies a very small space and can maintain good antenna transmission performance.

Description of the Related Art

In existing communication devices, the placement of the antenna must be as far away as possible from the surrounding metal components in order to avoid a loss of electromagnetic waves caused by the metal components affecting the transmission efficiency of the antenna. In notebook computers, a common antenna placement is to configure the antenna around the display module, to avoid taking up space in the main circuit board, and to avoid interference by noise on the main circuit board.

The display module also contains metal components. Therefore, a sufficiently wide distance must be maintained between the antenna and the display module to ensure that the transmission efficiency of the antenna is less susceptible to the influence of the display module. However, such a width requirement limits the size of the visible area of the screen, which in turn affects user experience. In addition, while demand for narrow-border electronic device products is also increasing, such width requirements are not conducive to the efficient design of narrow-border electronic device products.

To solve the problem mentioned above, a novel antenna structure which occupies a very small space and can maintain good antenna transmission performance, while taking into account user experience and the appearance of the electronic device, are proposed.

BRIEF SUMMARY OF THE INVENTION

In order to solve the above technical problem, the invention proposes a communications device. The communications device uses a nano-injection molding technique (NMT) process to integrate the metal radiator of the antenna structure with a filling material, so as to enhance the radiating ability based on the minimal antenna design. In addition, by using the NMT, the antenna structure and appearance of the communications device can be highly integrated and the appearance of the communications device will not be sacrificed, so as to follow market trends and meet consumer preferences (e.g. for a full-metal back cover and a narrow border).

In a preferred embodiment, the invention provides a communications device that includes a ground plane, a signal source, a filling material and an antenna. The signal source is electrically connected to the ground plane. The antenna has a predetermined metal pattern and is coupled to the signal source. The filling material is a non-conductive material and the filling material and the predetermined metal pattern are bonded heterogeneously via a surface-mount technology.

In some embodiments, the filling material is heterogeneously bonded to the ground plane via the surface-mount technology.

In some embodiments, selection of the non-conductive material is determined based on the radiating ability of the antenna.

In some embodiments, the dielectric coefficient of the filling material is between 1 and 5.

In some embodiments, the permeability coefficient of the filling material is 1.

In some embodiments, the loss tangent of the filling material is between 0.002 and 0.02.

In some embodiments, the filling material and the predetermined metal pattern are bonded by using injection technology.

In some embodiments, the predetermined metal pattern is formed on the filling material by using printing technology.

In some embodiments, the communications device further comprises a full-metal back cover. The filling material and the predetermined metal pattern are bonded heterogeneously on the top end of the full-metal back cover via the surface-mount technology.

In some embodiments, the top end of the full-metal back cover is perpendicular to the ground plane.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are described in detail below.

Figure 1:
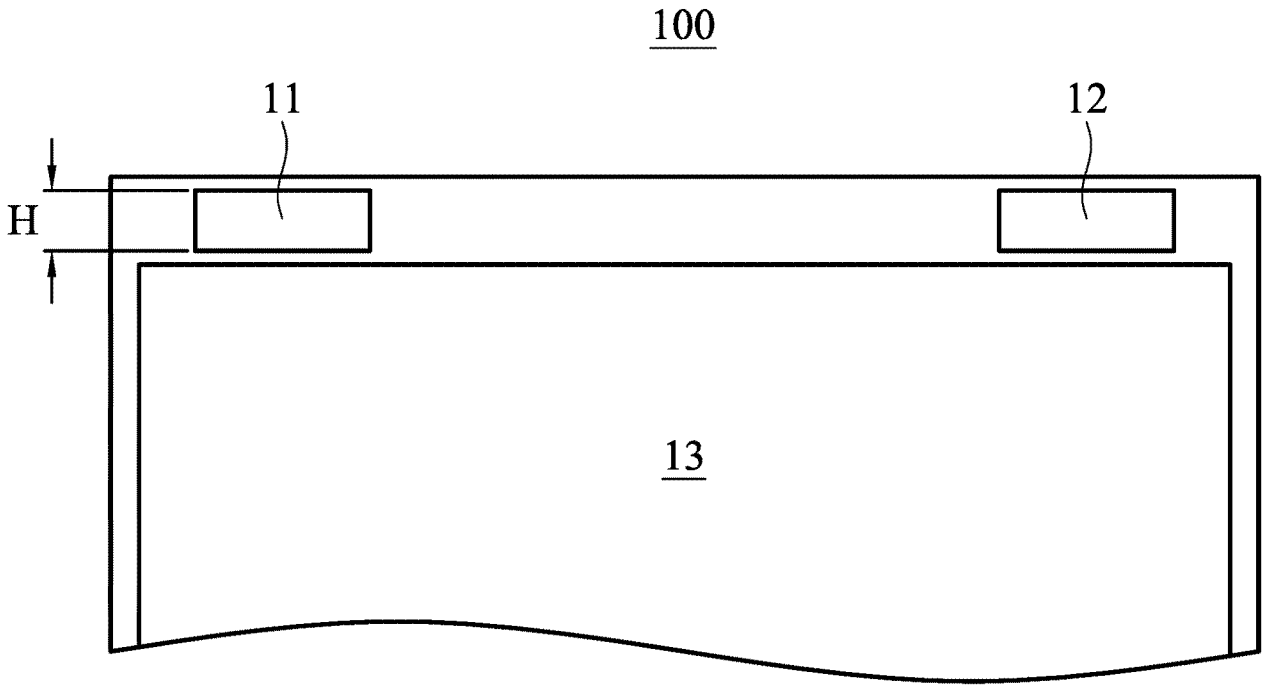
FIG. 1 (PRIOR ART)
FIG. 1 is a diagram of a conventional antenna design.

FIG. 1 shows an exemplary antenna configuration of a communications device 100 in the conventional design. The communications device 100 may comprise antennas 11 and 12 and LCD display module 13. In the conventional antenna configuration, the antennas are printed on a printed circuit board and are disposed above the LCD display module 13.

That is, the antennas and the LCD display module are configured on the same surface.

However, the height H required by the antennas 11 and 12 is about 7~10 mm, which actually occupies a great amount of border (or, the frame) area. In this manner, the narrow border (or, narrow frame) requirement cannot be fulfilled. Meanwhile, the design of the appearance of the communications device will be limited when the antenna is configured above the LCD display module 13. In addition, the dielectric coefficient and the loss tangent of the circuit board will also limit the freedom of designing the antenna and thereby decreasing the radiating ability. If the antenna is moved to another place which is close to the host, the transmission efficiency will be decreased since the antenna will receive an excessive amount noises from the main circuit board.

In recent years, demand for narrow borders in communications devices equipped with communication functionality, such as mobile phones, notebook computers, tablet PCs, and the like, has been increasing. Therefore, how to design an antenna which can take up very little space while still maintaining good transmission performance is the goal to be achieved by the invention.

In the embodiments of the invention, a nano-injection molding technique (NMT) is adopted to combine the antenna pattern with the metal housing, which achieves the goal of high integration of the antenna and the housing components and achieves the goal of minimalizing the antenna design. In conventional designs, if the antenna is configured above the LCD display module as shown in FIG. 1, the narrow-border design cannot be achieved due to the limitations on the height required by the antenna. In the embodiments of the invention, the antenna is directly configured in the border of the metal housing, for example, the top end of the metal housing and a low-posture design (that is, the height is less than 5 mm) may be adopted. Therefore, the proposed antenna design can be configured in the narrow-border area and is especially suitable for a communications device that is light and thin.

Figure 2A:
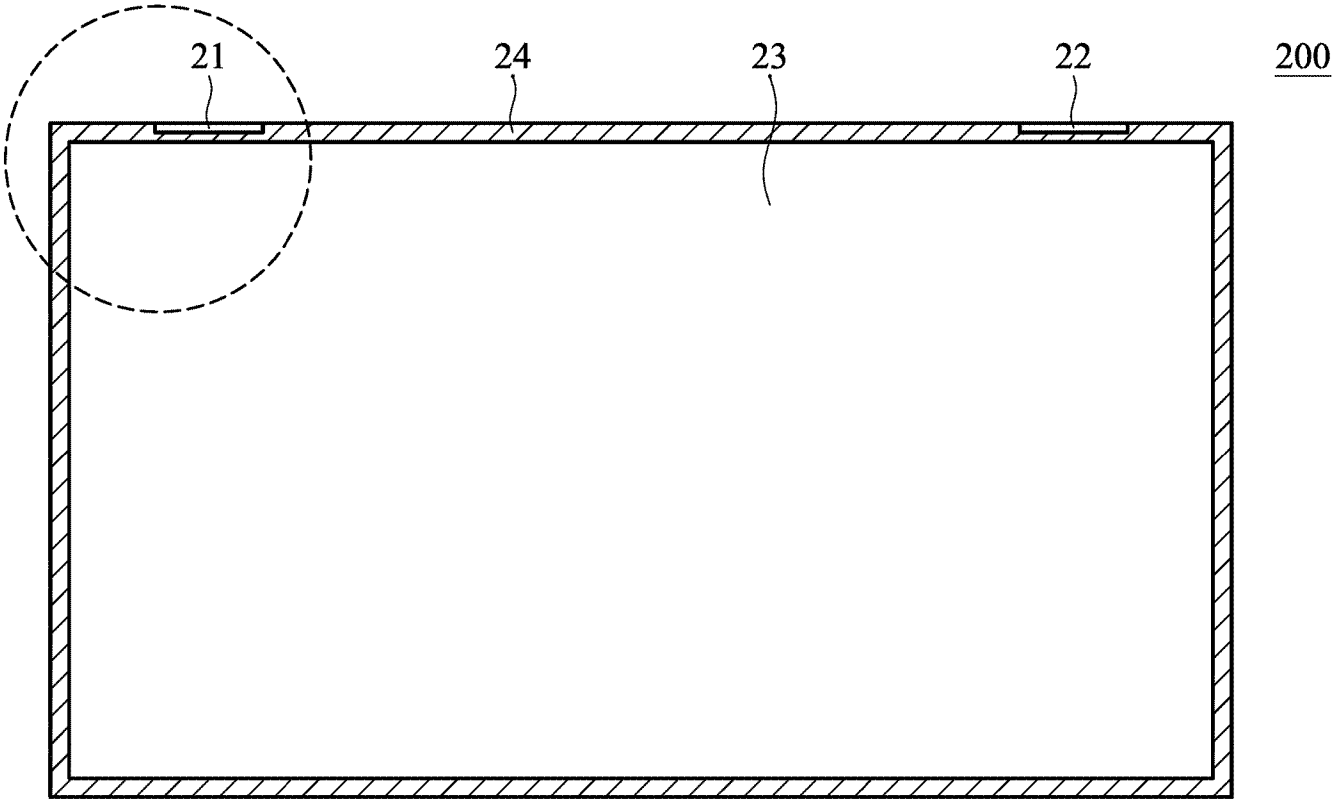
FIG. 2A and FIG. 2B show the exemplary antenna configurations in a communications device 200 according to an embodiment of the invention.
Figure 2B:
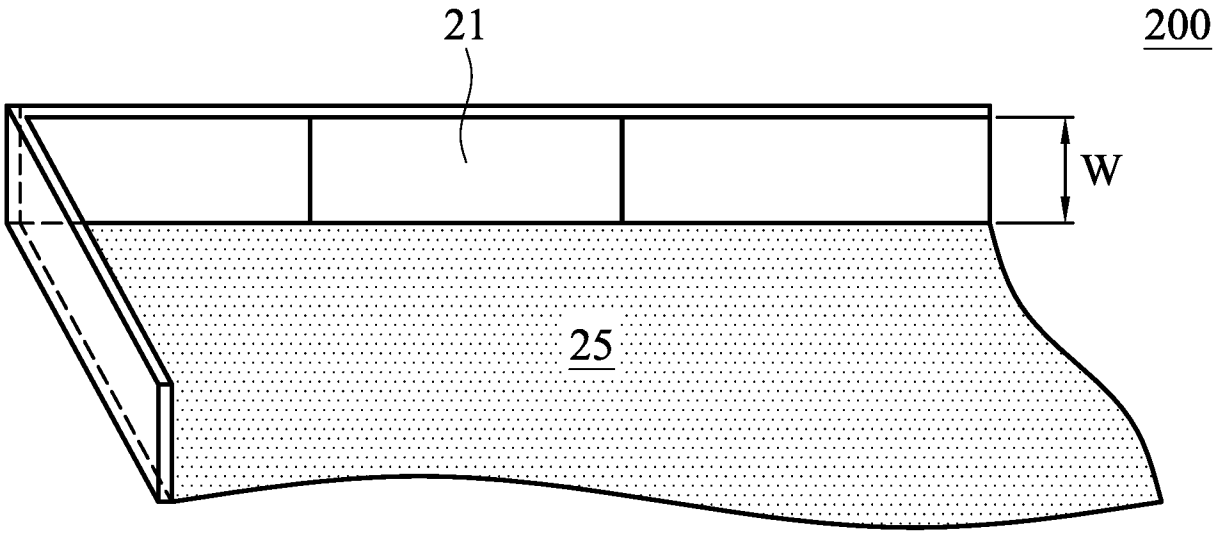
Figure 2C:
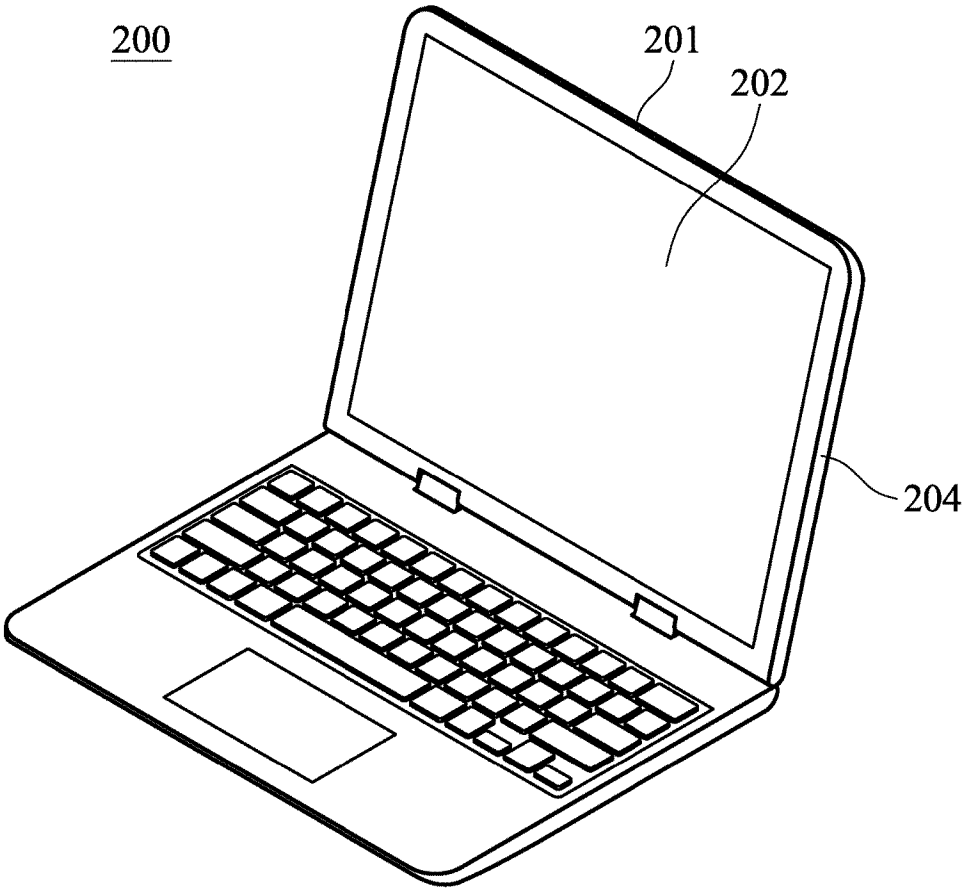
FIG. 2C and FIG. 2D show the exemplary appearance of the communications device according to an embodiment of the invention.
Figure 2D:
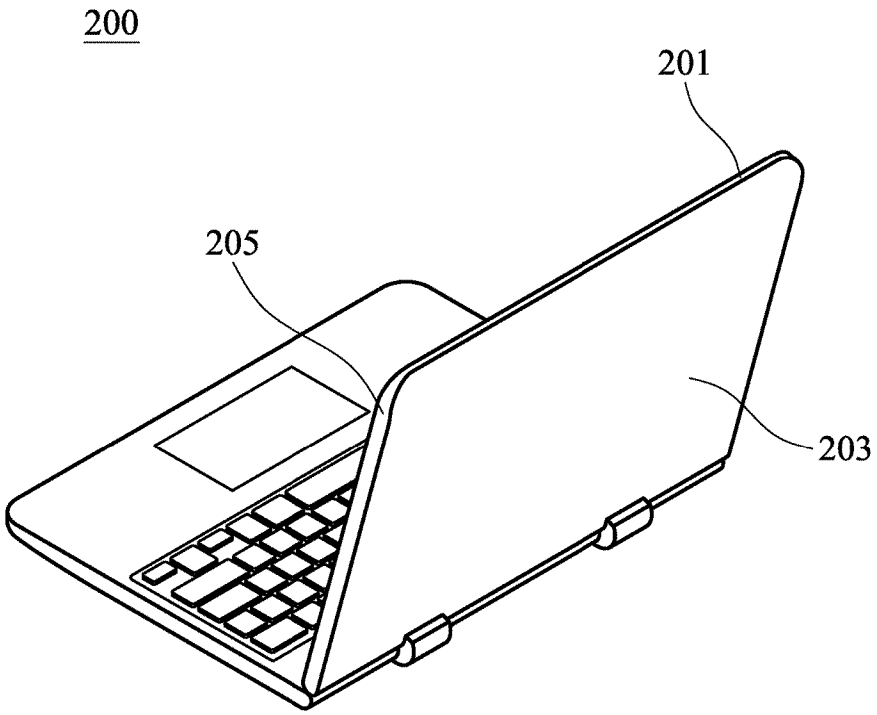

FIG. 2A and FIG. 2B show exemplary antenna configurations in a communications device 200 according to an embodiment of the invention. FIG. 2C and FIG. 2D show the exemplary appearance of the communications device according to an embodiment of the invention. In the embodiment of the invention, the antennas 21 and 22 use the low-posture design (as shown in FIG. 2B, the width W<5 mm), which is suitable for the general communications device that is light and thin (for example, the mobile phones, notebook computers, tablet PCs, the displays, etc.). In the embodiment of the invention, the communications device 200 may be a notebook computer, but the invention should not be limited thereto. As shown in FIG. 2A, the antennas 21 and 22 are configured in the narrow-border area 24 which fulfills the narrow-border requirement of the communication device. In addition, the antennas 21 and 22 are configured above the LCD display module 23 to prevent it from being interfered with by system noise. In addition, as shown in FIG. 2B, the metal portion of the antennas 21 and 22 and the metal back cover 25 can be made by one process (that is, the A-parts of the notebook computer is formed as a single piece). Then, the antennas 21 and 22 can be effectively bonded with the metal back cover 25 by using the NMT technique so that the antenna 21 and the antenna 22 are provided inside the A-parts of the notebook computer and cannot be seen by the user from the product appearance.

Note that in a conventional communications device such as a notebook computer, plastic materials are generally used to generate a slit to facilitate the radiation of the antenna because a slot antenna is usually used in the back cover of notebook computers. Therefore, such a design does not belong to the scope of full-metal back cover communications devices. In order to avoid the influence of the plastic material on the metallic luster of the back cover, and also to avoid generating holes in the back cover, a demand for full-metal back cover devices has arisen. Here, the full-metal back cover communications device refers to a communications device with a back cover that is completely made of metal materials, and does not contain plastic materials.

The proposed antenna structure can be applied to a communications device with a full-metal back cover, and the antenna can be directly configured at the border of the metal housing: For example, at the top end of the metal housing. As shown in FIG. 2C and FIG. 2D, the back cover area of the communications device 200 may be defined substantially by the top end 201, the front surface 202, the rear surface 203 and the lateral surfaces 204 and 205. The communications device 200 may comprise an LCD display module. Using a notebook computer as an example, the design of the back cover is usually liftable, such as a clamshell, and may comprise the LCD display panel of the LCD display module, and the LCD display panel is usually configured on the front surface 202.

When the communications device 200 powers up or is being used, the top end 201 generally faces upward to the sky. That is, facing toward the side opposite to where the pivot axis (not shown) connects the back cover to the host, so that the user can face the front surface. The top end 201, the rear surface 203, the lateral surfaces 204 and 205 and/or a portion of the front surface 202 of the metal housing form the device frames of the communications device 200. As discussed above, in the full-metal back cover design, the device frames are made of metal materials.

According to the design concept of the invention, in order to avoid limiting the design freedom of the antenna due to the circuit board material, in the embodiment of the invention, the antenna pattern is determined or defined first, so as to achieve the quality of appearance or to satisfy the strength of the housing. After that, the antenna's performance is adjusted by injecting plastic material with different material parameters.

Figure 3:
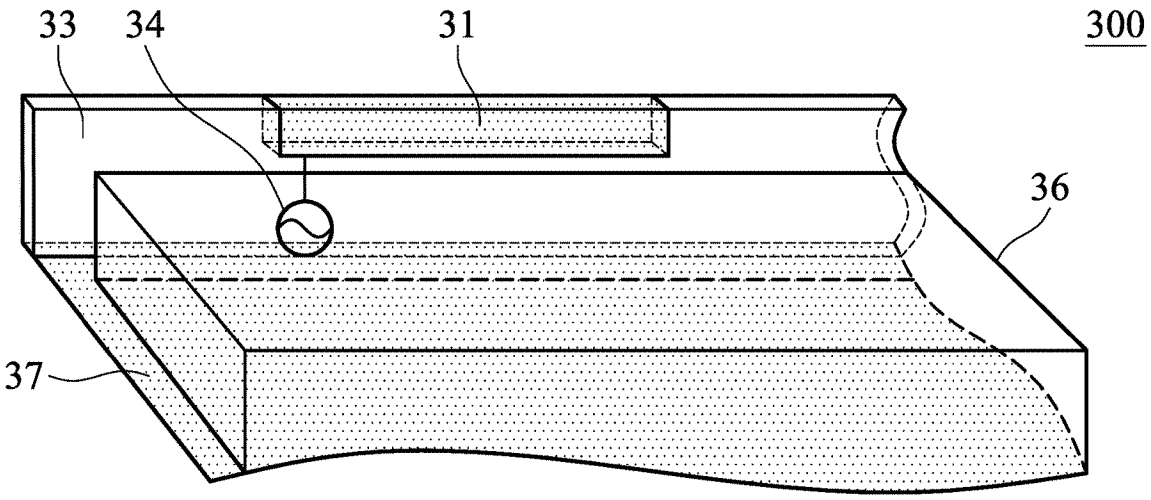
FIG. 3 is a diagram showing an exemplary antenna design according to an embodiment of the invention.

FIG. 3 is a diagram showing an exemplary antenna design according to an embodiment of the invention. The communications device 300 may comprise an antenna 31, a filling material 33, a signal source 34, a metal component 36 and a ground plane 37. The antenna 31 comprises a predetermined metal pattern and is coupled to the signal source 34. The signal source 34 is electrically connected to the ground plane 37. The filling material 33 is a non-conductive material and the filling material 33 and the predetermined metal pattern of the antenna 31 are bonded heterogeneously via a surface-mount technology. For example, according to an embodiment of the invention, the filling material 33 and the predetermined metal pattern of the antenna 31 are bonded heterogeneously on the top end of the full-metal back cover via the surface-mount technology.

In addition, the filling material 33 and the ground plane 37 are bonded heterogeneously via the surface-mount technology. The ground plane 37 may be the metal housing of the communications device 300, such as the rear surface of the full-metal back cover as discussed above. The top end that bonding the filling material 33 and the antenna 31 may be perpendicular to the ground plane 37.

The antenna 31 may be placed adjacent to the metal component 36, but is spaced apart by a predetermined distance, for example, by at least 3 mm. In the embodiment of the invention, the metal component 36 may be an LCD display module, an LCD display panel, a battery device, a camera module, a conductor structure, a metal base pan, or another metal component of the communications device 300.

Note that in the conventional antenna design, the material parameters of the circuit board or the substrate on which the antenna pattern is printed must be determined first, and then the antenna pattern should be designed based on these material parameters, so that the performance of the antenna can meet requirements. Therefore, in the conventional methods of antenna design, the freedom in designing the antenna is limited by the characteristics of the materials of the circuit board or the substrate.

However, unlike conventional methods of antenna design, in the embodiment of the invention, the pattern of the antenna 31 can be determined or defined first, and then the type of filling material 33 is determined based on the radiating ability of the antenna 31 (the antenna efficiency). That is, selection of the filling material 33 is determined based on the radiating ability of the antenna. Therefore, in the proposed antenna design methods, different plastic materials may be injected based on the radiating ability requirements of the frequency band that will actually be used, so as to achieve the required transmission efficiency of the communication device.

According to an embodiment of the invention, the antenna 31 may have a low-posture design, and may be a monopole antenna, a dipole antenna, a PIFA (Planer Inverse-F shape Antenna), a slot antenna, a loop antenna, or any other type of antenna.

According to an embodiment of the invention, using the 0.5 GHz~6 GHz communication band required by the communications device as an example, the dielectric coefficient of the selected filling material is preferably between 1 and 5. For example, the dielectric coefficient of the selected filling material may be 3.5±0.5. In addition, the permeability coefficient of the selected filling material is preferably 1. In addition, the loss tangent of the filling material is preferably between 0.002 and 0.02. For example, the loss tangent of the filling material may be 0.0027±0.0005.

In the embodiment shown in FIG. 3, the filling material 33 may have a three-dimensional structure (e.g., the thickness thereof may be 0.4 mm or above), and the filling material 33 may be heterogeneously bonded to the metal pattern of the antenna 31 via the NMT technique. In this way, the operating frequency band and the impedance matching of the antenna can be adjusted by changing the dielectric coefficient of the filling material (for example, by selecting different conductive/non-conductive materials), and the radiating ability of the antenna can be adjusted by changing the loss tangent of the filling material.

Figure 4:
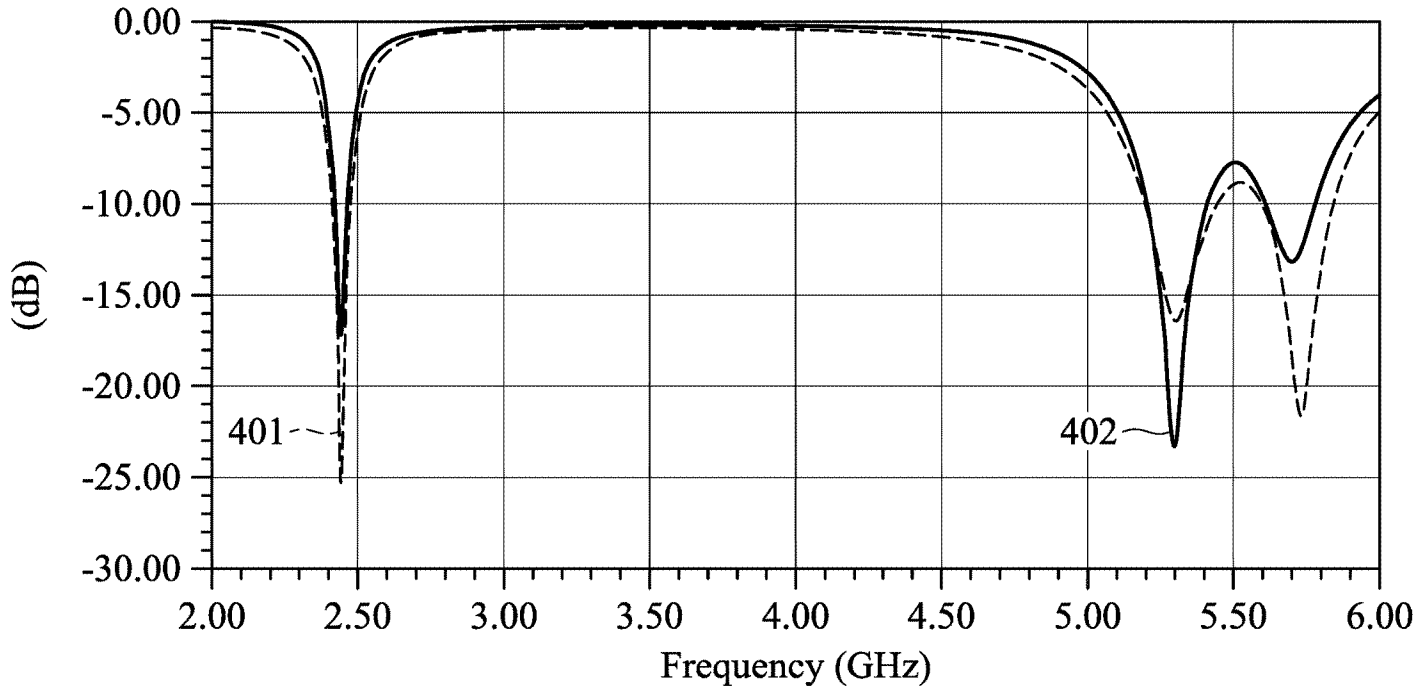
FIG. 4 is a diagram showing the obtained return loss of the proposed antenna design according to an embodiment of the invention.
Figure 7:
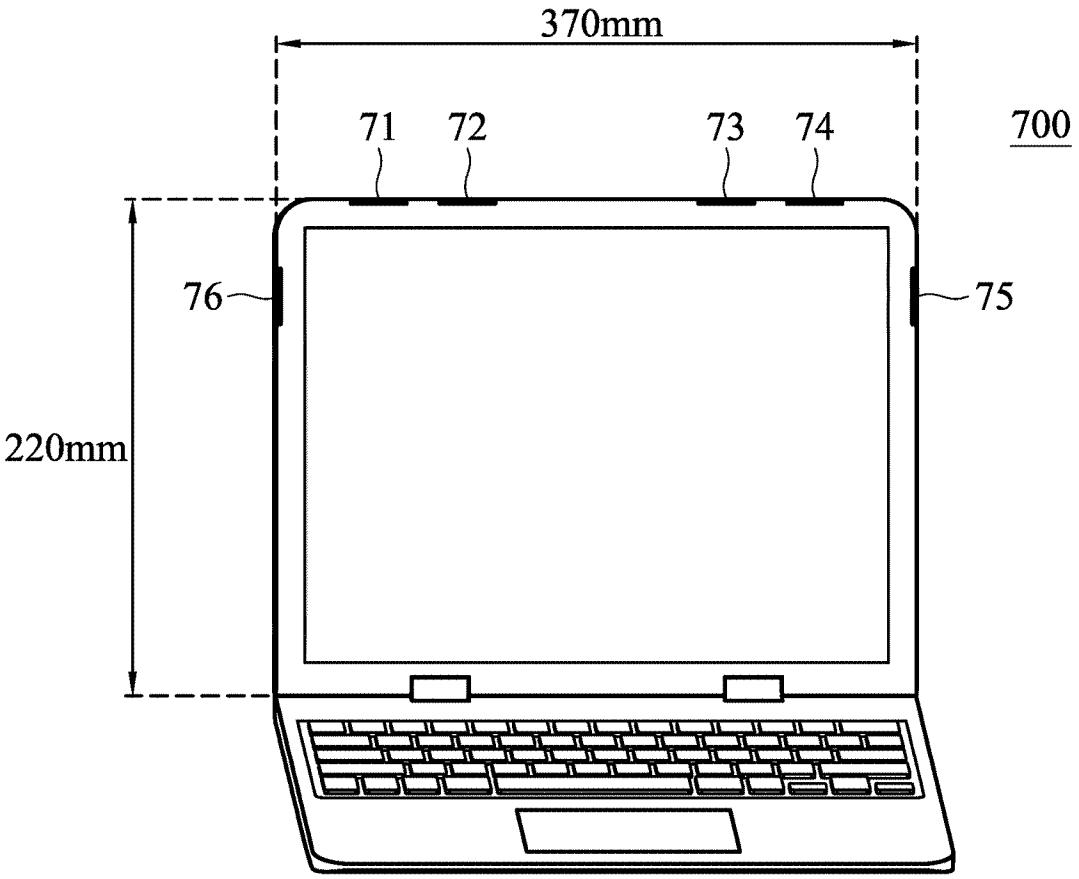
FIG. 7 is a diagram showing an exemplary antenna configuration according to an embodiment of the invention.

FIG. 4 is a diagram showing the obtained return loss of the proposed antenna design according to an embodiment of the invention. In this embodiment, the length of the ground plane is about 370 mm (as shown in FIG. 7), the width of the ground plane is about 220 mm, which is about size of the back cover of a 15-inch notebook computer. The length of the antenna is about 40 mm, and the width is about 3 mm. The curve 401 in FIG. 4 shows the return loss curve of the filling material whose dielectric coefficient is 4.4 (which is the same as a traditional FR4 substrate), the permeability coefficient is 1, the loss tangent is 0.02, and the curve 402 shows the return loss curve of the filling material whose dielectric coefficient is 3.05, the permeability coefficient is 1, and the loss tangent is 0.0027. As shown in the figure, both return loss curves cover the operating frequency band (about 2400~2484 MHz and 5150~5875 MHz) of the WLAN, and the performance on the return loss curve of the filling material is similar to that of the FR4 substrate. That is, both of them have a return loss that is lower than −8 dB, which means that the proposed antenna design has the value for actual application.

Figure 5:
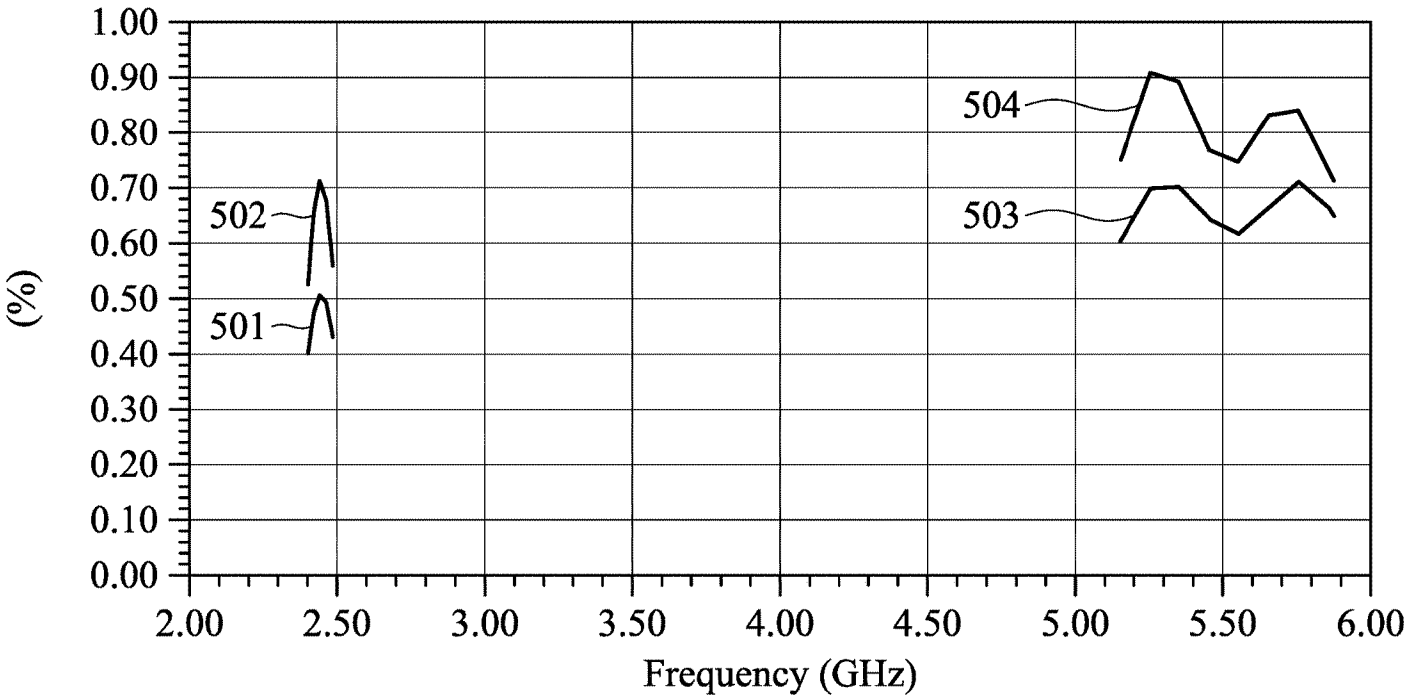
FIG. 5 is a diagram showing the antenna efficiency of the proposed antenna design according to an embodiment of the invention.

FIG. 5 is a diagram showing the antenna efficiency of the proposed antenna design according to an embodiment of the invention. In the diagram, the same antenna pattern is used. The curves 501 and 503 are the antenna efficiency curves of the antenna using general FR4 material, and the curves 502 and 504 are the antenna efficiency curves of the proposed antenna design using the proposed filling material. As shown in FIG. 5, in the 2.4 GHz frequency band (2400~2484 MHz), the antenna efficiency of curve 502 is 12~20% higher than the curve 501, and in the 5 GHz frequency band (5150~5875 MHz), the antenna efficiency of curve 504 is 15~21% higher than the curve 503. In the embodiment of the invention, the antenna efficiency in the operating band of the WLAN is about 52~91%, which is very good antenna efficiency in the small-size and low posture antenna design.

Figure 6:
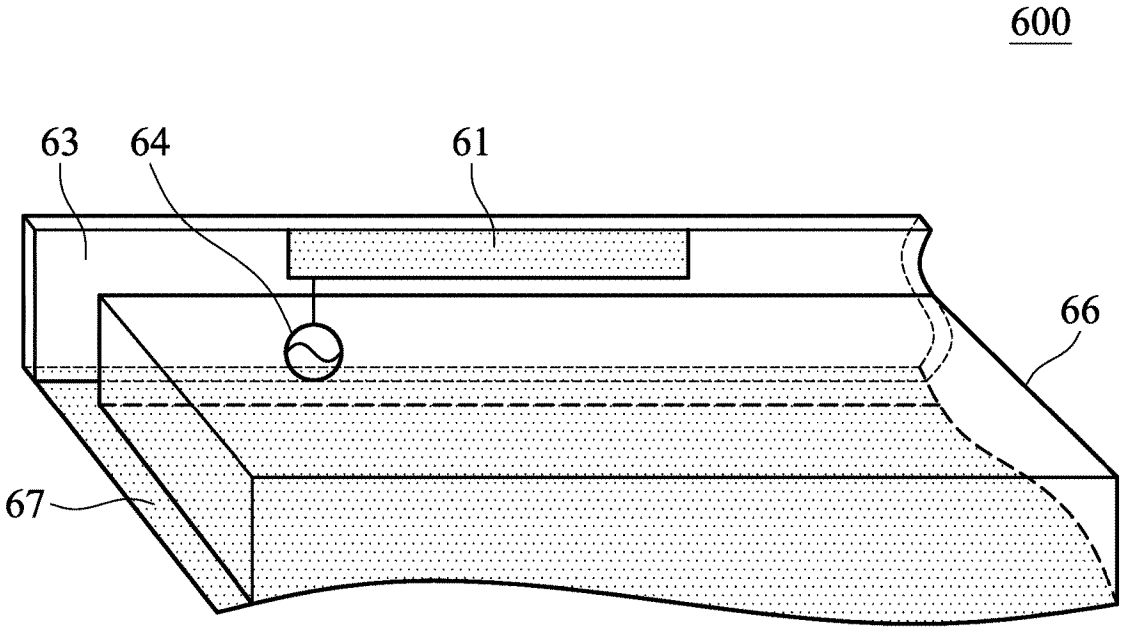
FIG. 6 is a diagram showing an exemplary antenna design according to another embodiment of the invention.

FIG. 6 is a diagram showing an exemplary antenna design according to another embodiment of the invention. The communications device 600 may comprise an antenna 61, a filling material 63, a signal source 64, a metal component 66 and a ground plane 67. The antenna 61 comprises a predetermined metal pattern and is coupled to the signal source 64. The signal source 64 is electrically connected to the ground plane 67. The filling material 63 is a non-conductive material and has a sheet structure (For example, the thickness thereof is under 0.4 mm).

In this embodiment, the predetermined metal pattern of the antenna 61 is formed on the filling material 63 by using printing technology. According to an embodiment of the invention, the filling material 63 and the antenna 61 are configured on the top end of the full-metal back cover.

In addition, the filling material 63 and the ground plane 67 are bonded heterogeneously via the surface-mount technology. The ground plane 67 may be the metal housing of the communications device 600, such as the rear surface of the full-metal back cover as discussed above. The top end that bonding the filling material 63 and the antenna 61 may be perpendicular to the ground plane 67.

The antenna 61 may be placed adjacent to the metal component 66, but is spaced apart by a predetermined distance, for example, by at least 3 mm. In the embodiment of the invention, the metal component 66 may be an LCD display module, an LCD display panel, a battery device, a camera module, a conductor structure, a metal phone box, or another metal component of the communications device 600.

Note that in the embodiments of the invention, the pattern of the antenna 61 can be determined or defined first, and then the type of filling material 63 can be determined based on the radiating ability of the antenna 61 (the antenna efficiency). That is, selection of the filling material 63 is determined based on the radiating ability of the antenna. Therefore, in the proposed methods of antenna design, different plastic materials may be injected based on the radiating ability requirement of the frequency band actually to be used, so as to achieve the required transmission efficiency of the communication device.

According to an embodiment of the invention, the antenna 61 may have a low-posture design, and may be a monopole antenna, a dipole antenna, a PIFA (Planer Inverse-F shape Antenna), a slot antenna, a loop antenna, or any other type of antenna.

According to an embodiment of the invention, using the 0.5 GHz~6 GHz communication band required by the communications device as an example, the dielectric coefficient of the selected filling material is preferably between 1 and 5. For example, the dielectric coefficient of the selected filling material may be 3.5±0.5. In addition, the permeability coefficient of the selected filling material is preferably 1. In addition, the loss tangent of the filling material is preferably between 0.002 and 0.02. For example, the loss tangent of the filling material may be 0.0027±0.0005.

In the embodiment shown in FIG. 6, the operating frequency band and the impedance matching of the antenna can be adjusted by changing the dielectric coefficient of the filling material (for example, by selecting different conductive/non-conductive materials), and the radiating ability of the antenna can be adjusted by changing the loss tangent of the filling material.

FIG. 7 is a diagram showing an exemplary antenna configuration according to an embodiment of the invention. As shown in FIG. 7, based on the proposed methods for designing the antenna, the antenna can be arbitrarily configured at any side of the housing of the communications device since the antenna only occupies very small area. In addition, the number of antennas can be flexibly adjusted based on the product requirements. For example, there may be a plurality of antennas 71, 72, 73 and 74 configured at the top end of the communications device 700, and a plurality of antennas 75 and 76 configured on the lateral surfaces, to form a MIMO system. Via the massive MIMO system, the wireless transmission speed and performance of the communications device can be greatly increased. In addition, based on the proposed methods for designing the antenna, the antenna design is no longer limited by the design of the product appearance, and there is no need to sacrifice the appearance of the product to achieve good radiating ability. In addition, the proposed antenna and the metal back cover can be made by one process and can be tightly bonded together, so that the antenna is provided inside the notebook computer and it cannot be seen by the user from the product appearance, further enhancing the tactile quality of the product appearance.

It will be apparent to those skilled in the art that various modifications and variations can be made in the invention. It is intended that the standard and examples be considered as exemplary only, with the true scope of the disclosed embodiments being indicated by the following claims and their equivalents.

What is claimed is:

1. A communications device, comprising:

a ground plane;

a signal source, electrically connected to the ground plane;

a filling material; and a predetermined metal pattern coupled to the signal source, wherein the filling material is a non-conductive material and the filling material and the predetermined metal pattern are bonded heterogeneously via a surface-mount technology, wherein the predetermined metal pattern includes a plurality of antennas separated from each other, which are configured away from an LCD display module to prevent them from being interfered with by system noise, wherein some of the plurality of antennas are configured at a top end of the communications device, and others of the plurality of antennas are configured on lateral surfaces of the communications device, to form a MIMO (Multi-Input Multi-Output) system; and wherein the communications device further comprises:

a full-metal back cover, wherein the filling material and the predetermined metal pattern are bonded heterogeneously on a top end of the full-metal back cover via the surface-mount technology.

2. The communications device as claimed in claim 1, wherein the filling material is heterogeneously bonded to the ground plane via the surface-mount technology.

3. The communications device as claimed in claim 1, wherein selection of the non-conductive material is determined based on a radiating ability of the predetermined metal pattern.

4. The communications device as claimed in claim 1, wherein the dielectric coefficient of the filling material is between 1 and 5.

5. The communications device as claimed in claim 1, wherein the permeability coefficient of the filling material is 1.

6. The communications device as claimed in claim 1, wherein the loss tangent of the filling material is between 0.002 and 0.02.

7. The communications device as claimed in claim 1, wherein the filling material and the predetermined metal pattern are bonded by using injection technology.

8. The communications device as claimed in claim 1, wherein the predetermined metal pattern is formed on the filling material by using printing technology.

9. The communications device as claimed in claim 1, wherein the top end of the full-metal back cover is perpendicular to the ground plane.

* * * * *